US007247033B2

(12) United States Patent
Skowranek

(10) Patent No.: US 7,247,033 B2
(45) Date of Patent: Jul. 24, 2007

(54) PLUG CONNECTOR FOR CIRCUIT BOARD CONNECTION

(75) Inventor: Antje Skowranek, Horn-Bad Meinberg (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 11/444,293

(22) Filed: May 31, 2006

(65) Prior Publication Data

US 2006/0270253 A1 Nov. 30, 2006

(30) Foreign Application Priority Data

May 31, 2005 (DE) ..... 10 2005 024 732

(51) Int. Cl.
*H01R 12/00* (2006.01)

(52) U.S. Cl. ..... 439/79; 439/78; 439/709

(58) Field of Classification Search ..... 439/660, 439/78, 79, 357, 358, 83, 709
See application file for complete search history.

(56) References Cited

U.S. PATENT DOCUMENTS

| | | | | |
|---|---|---|---|---|
| 4,997,376 | A * | 3/1991 | Buck et al. | 439/59 |
| 5,655,914 | A * | 8/1997 | McCartin et al. | 439/78 |
| 5,785,536 | A * | 7/1998 | McCartin et al. | 439/78 |
| 6,146,181 | A * | 11/2000 | Plaza | 439/357 |
| 6,343,951 | B1 * | 2/2002 | Ono et al. | 439/571 |
| 6,386,884 | B1 * | 5/2002 | Sloey | 439/11 |
| 6,454,610 | B1 * | 9/2002 | Yu | 439/660 |
| 6,793,537 | B2 * | 9/2004 | Stefaniu et al. | 439/660 |
| 2006/0134949 | A1 * | 6/2006 | Wang | 439/79 |

FOREIGN PATENT DOCUMENTS

| | | |
|---|---|---|
| DE | 7922314 | 11/1979 |
| DE | 29623742 | 11/1999 |
| DE | 198 34 681 | 5/2000 |
| DE | 102 54 091 | 6/2004 |

* cited by examiner

*Primary Examiner*—Tulsidas C. Patel
*Assistant Examiner*—Harshad C Patel
(74) *Attorney, Agent, or Firm*—Bourque and Associates

(57) ABSTRACT

A plug connector for a circuit board connection possesses a plug strip and a plug part that includes a socket housing projecting on the plug side. The socket housing possesses a generally rectangular basic cross section with longitudinal sides opposite each other on both sides, and a face side located between them. Insertion guide holes with adjacent plug receptors for contact pins are located on this face side, such pins being positioned on the plug strip with matching alignment. In order to be able to join the plug part and the plug strip along at least two insertion directions offset from each other by 90°, and to ensure a solid mechanical connection of the plug part independent of insertion direction, first the plug strip is formed as an angle strip with a first strip shoulder and a second strip shoulder perpendicular to it, and the contact pins are mounted either on the first or on the second strip shoulder. Engaging hooks are present on each of the two strip shoulders on the inner side facing the plug part that are mirror images with respect to the angle-bisecting plane of the plug strip, and engaging steps are provided in the vicinity of the two longitudinal sides of the socket housing on the plug part that may be engaged by the engaging hook. The position of such engaging steps is matched to allow interaction with the engaging hook on each longitudinal side of the socket housing.

7 Claims, 5 Drawing Sheets

PLUG CONNECTOR FOR CIRCUIT BOARD CONNECTION

TECHNICAL FIELD

The invention concerns a plug connector per the characteristics of the overall concept of claim 1.

BACKGROUND INFORMATION

Many versions of such plug connectors are known in which a plug strip is provided on the one hand to be connected mechanically to a circuit board, and on the other, to establish electrical contact with the circuit board. It is the task of the plug part of the plug connector to electrically connect incoming or outgoing conductors to the plug strip and thereby to the components on the circuit board. Suitable clamps are provided on or in the plug part to connect these conductors.

It is further known to connect the plug part with the plug strip. For this, a threaded connector is provided whereby accordingly the plug part is shaped as a threaded plug, and the plug strip is provided with threaded flanges. In such versions of the plug connector, the plug part and the plug strip may be inserted together in only one direction.

It is the task of the present invention to create a plug connector of the type mentioned at the outset in which the plug part and the plug strip may be inserted together along at least two insertion directions offset from each other by 90° depending on the positions of the contact pins on the plug strip and to ensure a solid mechanical connection of the plug part independent of insertion direction.

SUMMARY

It is essential to the invention to be able to select between two insertion directions between the plug part and the plug strip. Thus, the contact pins may be positioned on the strip shoulder perpendicular with respect to the circuit board of the plug strip for horizontal plug connection, or on the strip shoulder lying on the circuit board for vertical plug connection. In both cases, the plug part may be engaged with the plug strip in that the engaging steps positioned along the longitudinal sides of the socket housing on the plug part engage with the engaging hooks either on the strip shoulder lying on the circuit board or the strip shoulder of the plug strip perpendicular to it. For this, the plug part is guided in the insertion direction toward the contact pins that are firmly attached to the plug strip, and the plug receptors within the socket housing of the plug part serve for this that are shaped as hollow cylinders to match the cylindrical contact pins.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
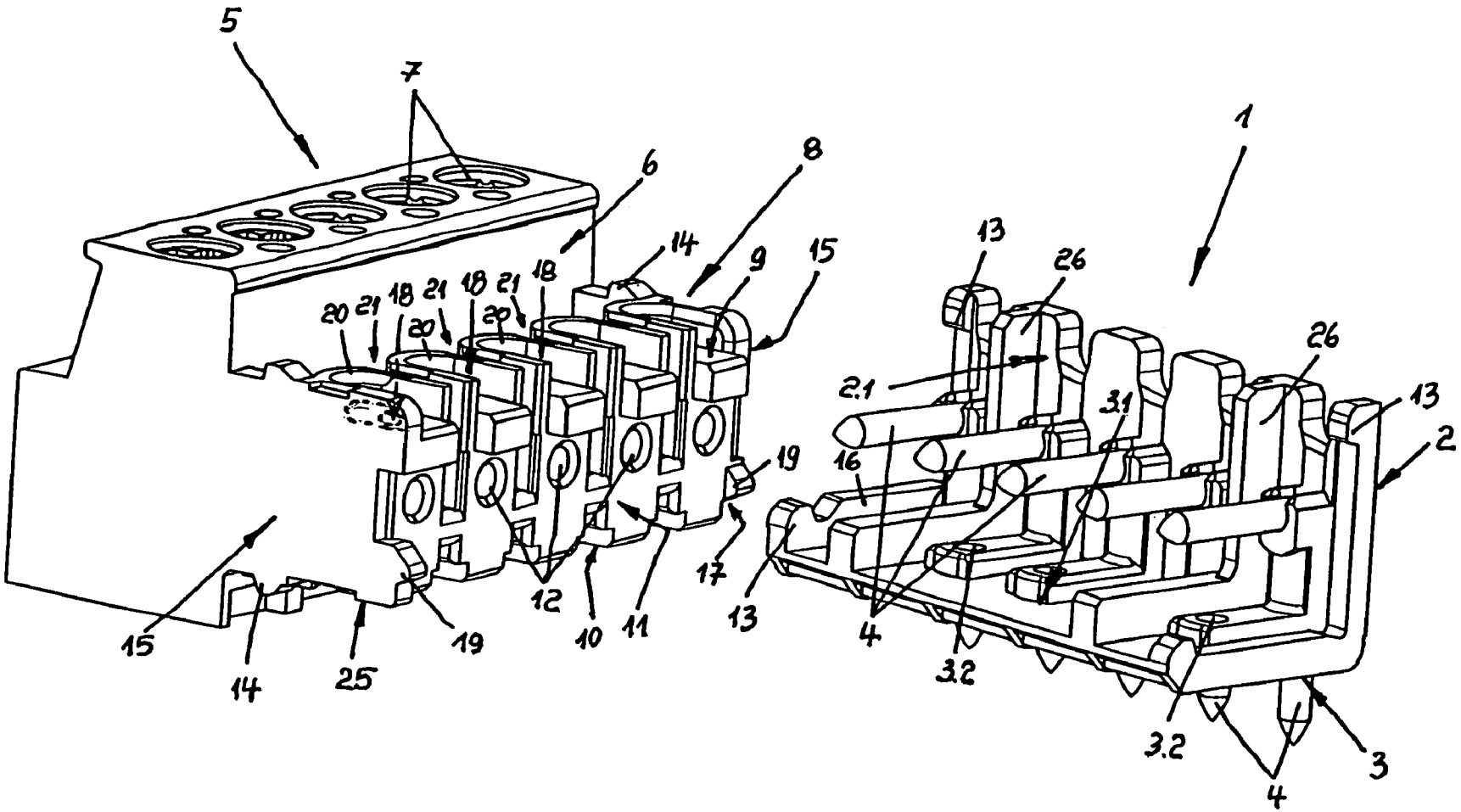
FIG. 1 is a perspective view of the plug strip and plug part of a plug connector, each seen from the plug side, according to the present invention.

FIG. 1 shows the plug strip 1 of the plug connector that is formed as an angle strip. Thus, the plug strip 1 possesses a first strip shoulder 2 and a second strip shoulder 3, and both strip shoulders 2, 3 are at a right angle to each other. Contact pins 4 project on the inner side 2.1 of the first strip shoulder 2 facing the second strip shoulder 3 and stand perpendicular to the first strip shoulder 2, and are correspondingly parallel to the second strip shoulder 3. The contact pins 4 lie with their longitudinal axes in a common plane parallel to the second strip shoulder 3, and are of the same length. The contact pins 4 are either inserted into the plug strip 1 with permanent attachment, or are molded into the plug strip 1 formed of plastic as an injection-molded part. The contact pins 4 project downward over the underside of the plug strip 1, and the contact pins 4 are accordingly shaped as angled pins in the embodiment example in FIG. 1. The underside of the plug strip 1 is defined by the underside of the second strip shoulder 3 that correspondingly functions as a support shoulder and is placed on the circuit board concerned.

Figure 4:
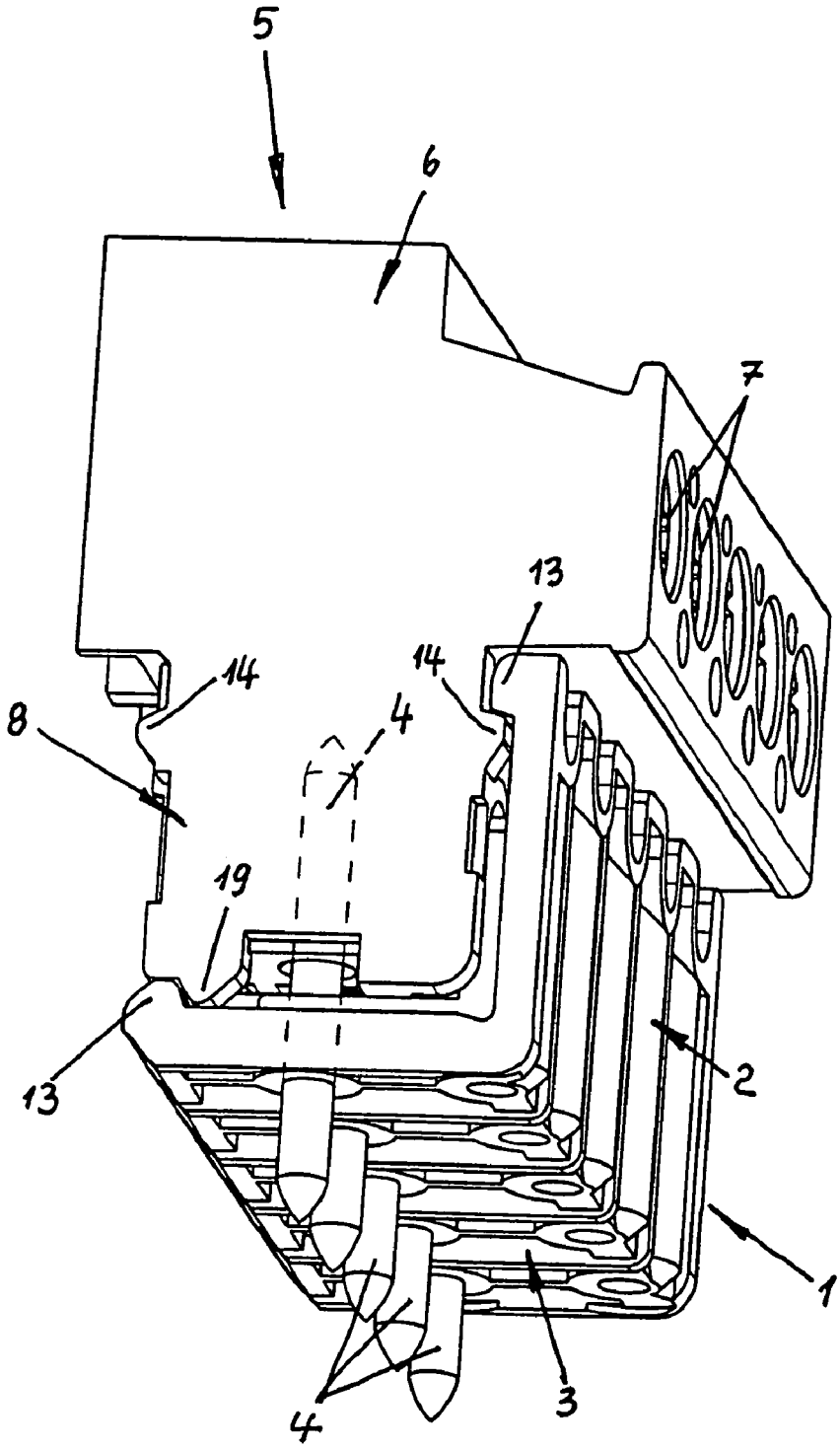
FIG. 4 is a perspective view of the plug connector of FIGS. 1-3 during vertical insertion of plug part and plug strip.

In another version of the plug connector explained in the following using FIG. 4, the contact pins 4 on the second strip shoulder 3 project on its inner side 3.1, for which penetrating holes 3.2 may be provided in the second strip shoulder 3 for an insertable configuration. In this case, the alignment of the contact pins 4 along the inner side of the second strip shoulder 3 is similar to the illustrated version, but rotated 90°. As FIG. 4 shows, contact pins 4 may be used for this version that extend downward out of the second strip shoulder 3.

Further, FIG. 1 reproduces in detail the design of the plug part 5 that includes a connection housing 6 with connection openings 7 for incoming and outgoing electrical conductors. Corresponding terminals are provided within the connection housing 6 for electrical contact of these conductors. The connection housing 6 is formed as one piece with a socket housing 8 in which sockets are positioned to come into contact with the contact pins 4 of the plug strip 1. The socket housing 8 possesses on its outer side a lightly fractured shape, but the basic cross-sectional shape of the socket housing is rectangular, i.e. rectangular or square. The socket housing 8 connects to the connection housing 6 by means of one of its rectangle or square sides of its cross section. Thus, the socket housing 8 possesses a first longitudinal side 9 interrupted by projections, and a second longitudinal side 10 that is parallel because of its basic shape. The front-facing face side 11 of the socket housing 8 lies perpendicular to this along the insertion direction whose attached sections lie in a plane, as do each of the longitudinal sides 9 and 10 of the socket housing 8.

Insertion holes 12 are located on the face side 11 of the socket housing 8 that are positioned in a row corresponding to the arrangement of the contact pins 4 on the plug strip 1. Mechanical guides facing inward are connected to the insertion holes 12 for each of the contact pins 4 that prevent tipping of the plug part 5 away from the insertion direction during insertion of the plug part 5 into the plug strip 1.

If the plug part 5 reaches its end position upon insertion into the plug strip 1, the plug part 5 and the plug strip 1 are engaged with each other automatically. For this, engaging hooks 13 are provided on the plug strip 1 that on the one hand project from the inner sides 2.1 and 3.1 of the two strip shoulders 2, 3, and on the other hand are located on each free corner or corner areas of the strip shoulders 2, 3. Thus, there are two engaging hooks 13 present on each of the two strip shoulders 2, 3. With respect to a plane extending at an angle of 45° equally between the two strip shoulders 2, 3 and passing through the crown area of the angled plug strip 1, the two engaging hooks 13 on each inner side of the plug strip 1 are formed and positioned to be mirror images of each other. In other words, the engaging hooks 13 are mirror-symmetrical to the plane extending through the bisection of the 90° angle of the plug strip 1 at which the strip shoulders 2, 3 of the plug strip 1 stand to each other.

Figure 3:
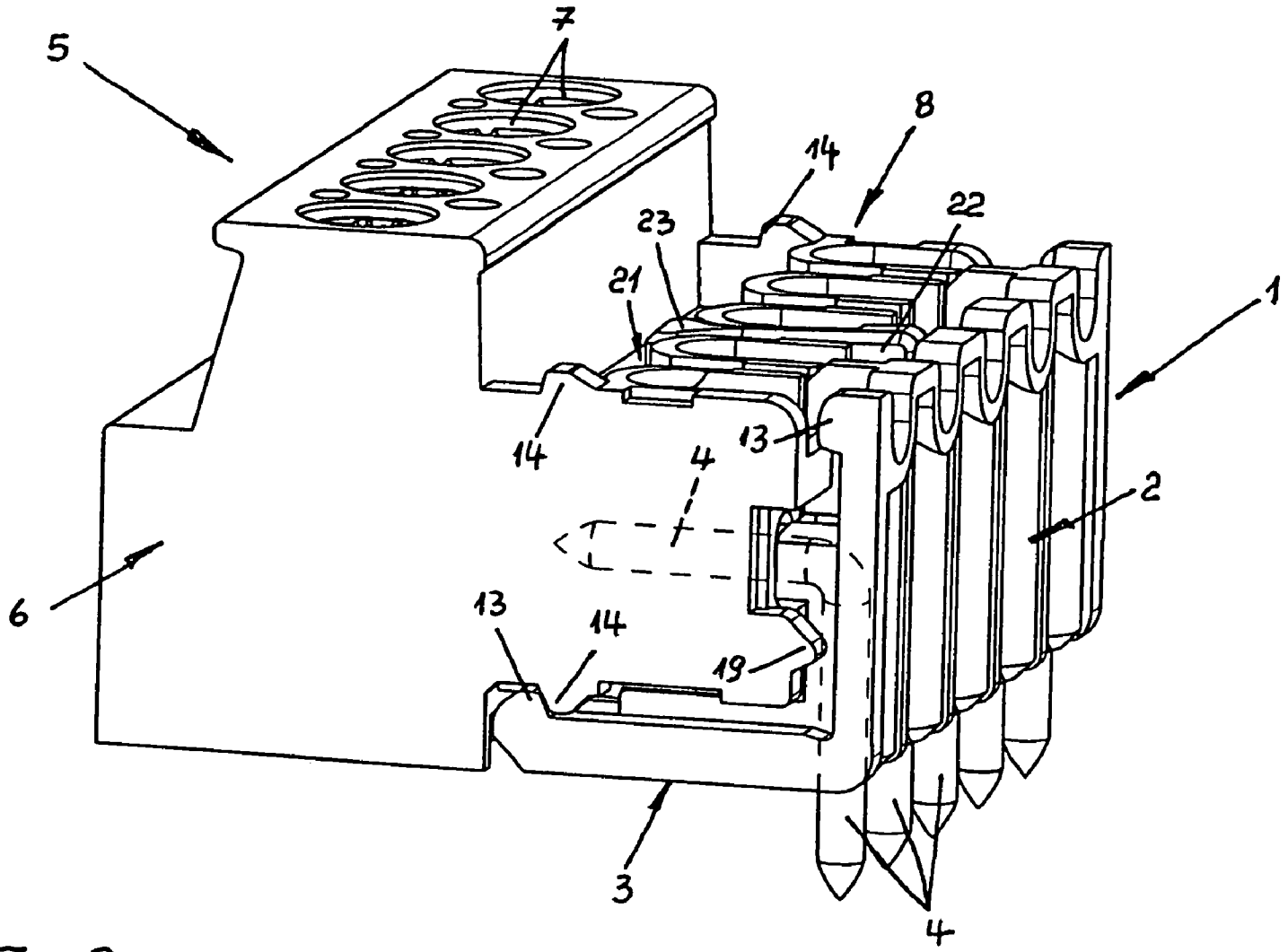
FIG. 3 is a perspective view of the plug connector of FIGS. 1 and 2 during horizontal insertion of plug part and plug strip.

Steps for engaging 14 are provided on the socket housing 8 of the plug part 5 in corresponding arrangement, two of which engage with two of the engaging hooks 13 on the plug strip 1 when the plug part 5 is completely engaged with the plug strip 1. So that this results both along the insertion direction shown in FIG. 3 and along the insertion direction shown in FIG. 4, engaging steps 14 are provided in the area of each of the longitudinal sides 9 and 10 of the socket housing 8 for the corresponding engaging hooks 13. With respect to rectangular cross-sectional shape of the socket housing 8 on the plug part 5, the engaging steps 14 on both longitudinal sides 9, 10 of the socket housing 8 possess the same separation to that adjacent edge lines that result by the three mutually-perpendicular planes that contain the socket housing 8 parallel to its face side 11. Thus, either the engaging steps 14 in the vicinity of the longitudinal side 10 on the socket housing 8 and the engaging hook 13 on the second strip shoulder 3 of the plug strip 1 as FIG. 3 shows, or as FIG. 4 shows, the engaging steps 14 in the vicinity of the longitudinal side 9 on the socket housing 8 and the engaging hooks 13 on the first strip shoulder 2 of the plug strip 1 engage with each other. The named separation corresponds to the separation that the engaging hooks 13 possess to the rectangular plug strip 1.

For practical implementation, the engaging steps 14 are positioned on the two cross sidewalls 15 of the socket housing 8 facing each other, and possess the shape of projecting engagement notches on the projecting thin sides of these cross sidewalls 15. The overlaps of the one cross sidewall 15 over the longitudinal sides 9, 10 of the socket housing 8 may be used as coding elements that interact with the recesses to be provided on the side of the plug strip 2 on the inner sides 2.1, 3.1 of the strip shoulders 2, 3 facing them between the corresponding engaging hooks 13. In contrast, as may be seen from the embodiment examples in FIGS. 1 and 2, projecting side walls 16 may be positioned on one side of the plug strip 1 between its engaging hooks 13 on the inner sides 2.1, 3.1 of the strip shoulders 2, 3 that interact with a recoil 17 that is provided on the corresponding cross side wall 15 of the socket housing 8 on the plug part 5.

Figure 5:
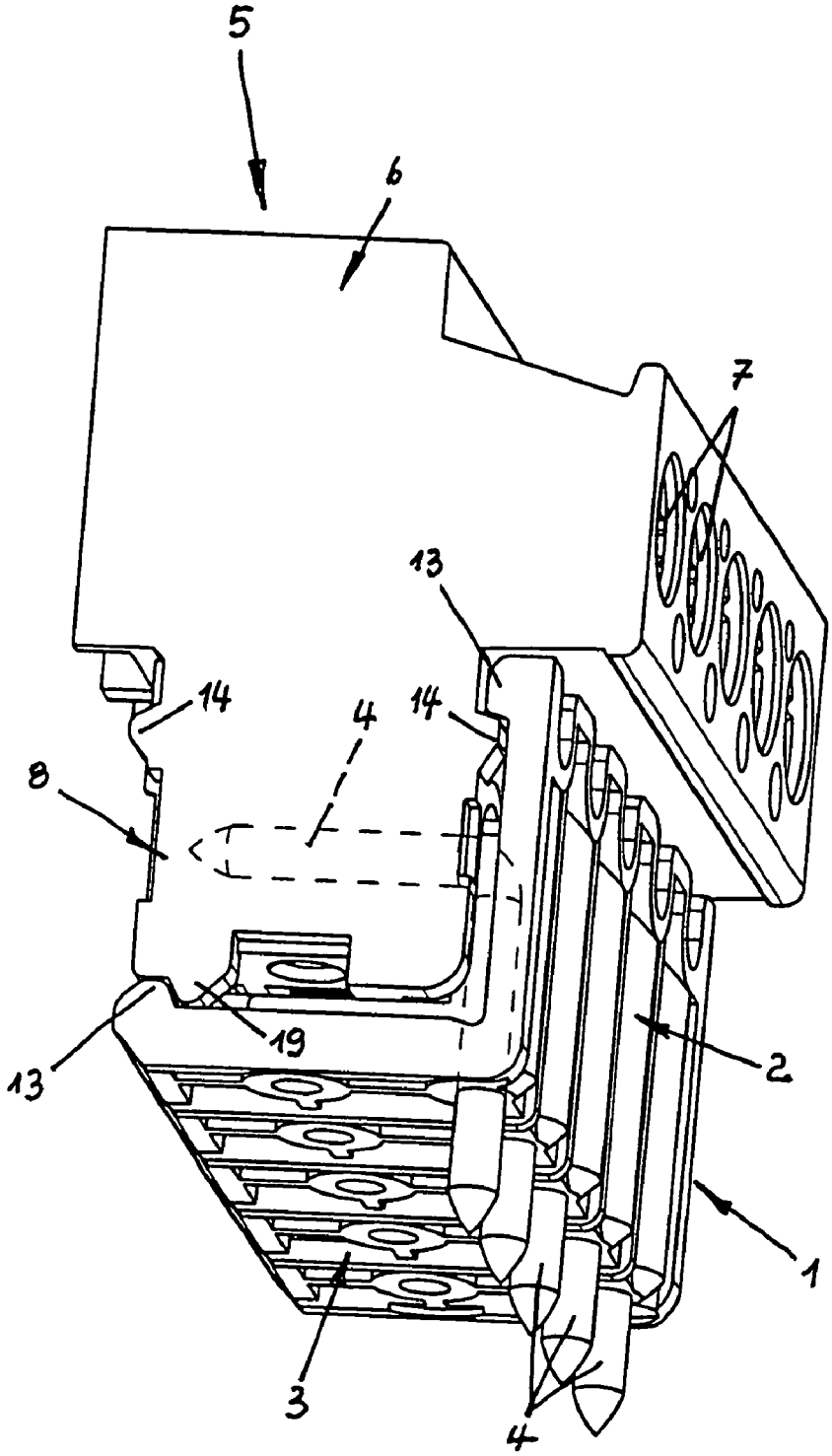
FIG. 5 is another perspective view of the plug connector of FIGS. 1-4 during different insertion of plug part and plug strip.

Additional insertion holes 18 are positioned along the one longitudinal side 9 of the socket housing 8 on the plug part 5 that are analogous to insertion holes 12 but aligned with 90° displacement, to which, similarly to the insertion holes 12, recesses with guides for the contact pins 4 are adjacent to the plug strip 1 in the interior of the socket housing 8. These additional insertion holes 18 allow insertion of the plug part 5 into the plug strip 1, as shown in FIG. 5. So that displacement also occurs between the socket housing 8 on the plug part 5 and the plug strip 1, additional engaging steps or notches 19 are positioned on the socket housing 8 in the vicinity of its front face 11. These additional engaging steps 19 possess the same separation from the edge or from the theoretical edge line in the transition area between the front face 11 and the longitudinal side 9 with the insertion guide holes 18 of the socket housing 8 as do the engaging steps 14 along this longitudinal side 9. Thus, the engaging steps 14 and the engaging steps 19 are mirror-symmetrical to each other with respect to the bisecting plane that passes through the edge of the socket housing 8 located in between, as is the case in similar manner with the engaging hook 13 of the plug strip 1. As FIG. 5 shows, the engaging steps 19 in the vicinity of the face side 11 of the socket housing 8 and the engaging hooks 13 on the second strip shoulder 3 of the plug strip 1 in the inserted position of the plug part 5 are mutually engaged.

Figure 2:
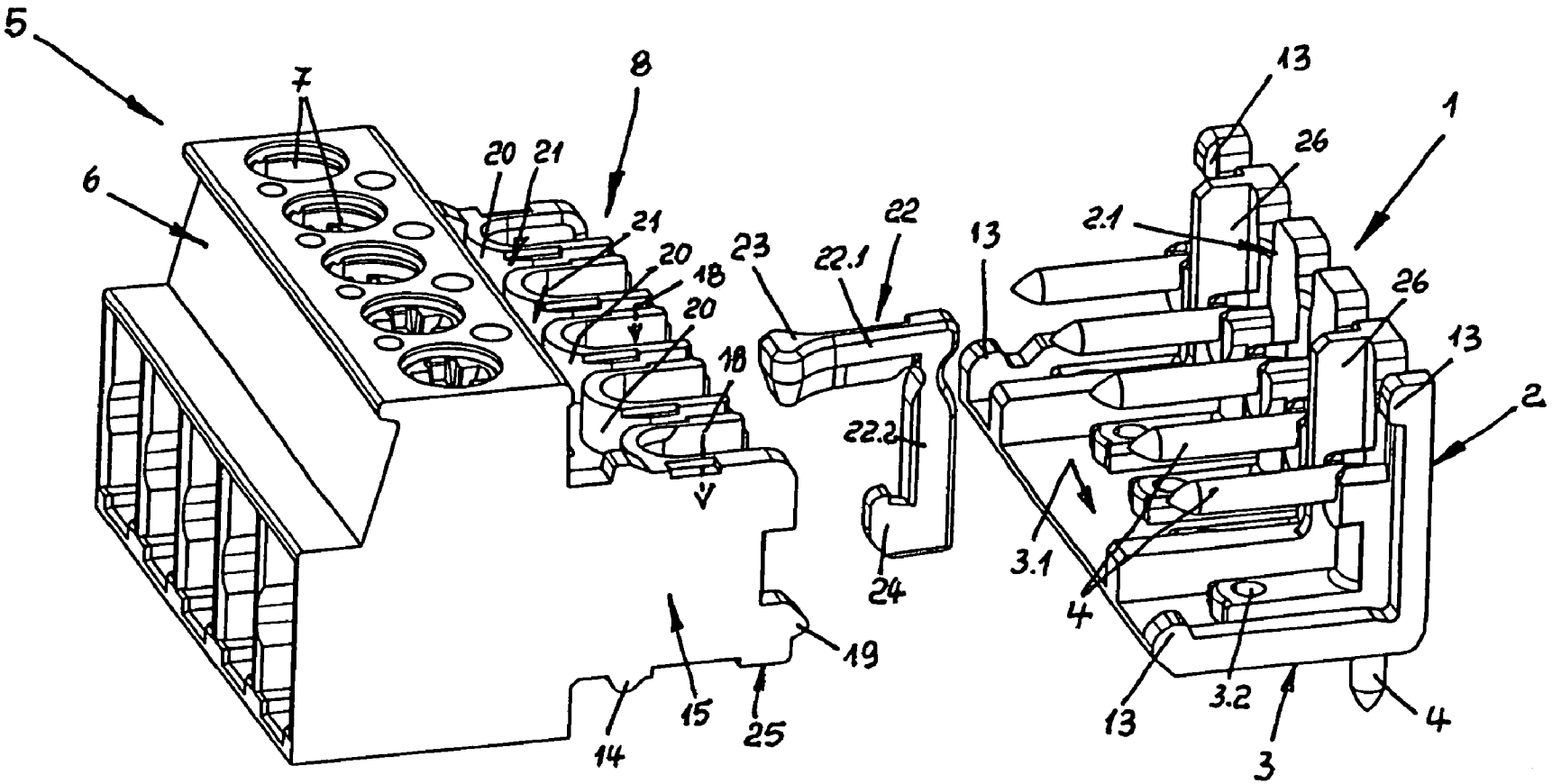
FIG. 2 is another perspective view of the plug connector per FIG. 1 with plug strip and plug part separated from each other along the insertion direction.

As FIG. 2 particularly shows, the additional insertion holes 18 along the longitudinal side 9 of the socket housing 8 is surrounded by collars 20 that project along the longitudinal side 9 and surround the insertion holes 18 along their side facing away from face side 11 of the socket housing 8. Gusset spaces 21 are formed between the collars 18 that expand in the direction of the connection housing 6 of the plug part 5. Coding angles 22 are matched to these gusset spaces that include flanks 22.1 and 22.2 perpendicular to each other. A thickened head 23 is shaped on the end of the flank 22.1 of the coding angle 22 that fits into the above-mentioned gusset spaces 21 behind the collar 20 on the longitudinal side 9 of the socket housing 8. A hook-shaped engaging member 24 is provided on the second flank 22.2 of the coding angle 22 by means of which the code angles 22 engage the socket housing 8 on the plug part 5 on its second longitudinal side 10, and there may come into engagement with an engaging projection 15. Thus, the coding angle 22 may engage between two of the insertion holes 12 and the additional insertion hole 18 with the socket housing 8 of the plug part 5 that the flank 22.2 of the coding angle 22 projects on the front face 11 of the socket housing 8.

Projecting coding ribs 26 that may be broken off are provided along the inner sides 2.1, 3.1 of the pertinent strip shoulders 2, 3 of the plug strip 1 that interact with the coding angles 22. For this, the coding ribs 26 are connected with the corresponding plug strip 1 using intentional break zones. In order to prevent polarity crossing between the plug part 5 and the plug strip 1, the coding angles 22 are so emplaced on the socket housing that they do not collide with the coding ribs 26 when the alignment of plug part 5 and plug strip 1 is correct.

Modifications and substitutions by one of ordinary skill in the art are considered to be within the scope of the present invention, which is not to be limited except by the following claims.

The invention claimed is:

1. A plug connector for a circuit board connection possessing a plug strip (1) mounted on the circuit board and a plug part (5) that includes a socket housing (8) projecting on the plug side that possesses a generally rectangular cross section with longitudinal sides (9, 10) opposite each other, and a face side (11) located between them, whereby insertion guide holes (12) with adjacent plug receptors for contact pins (4) are located on this face side (11), said pins being firmly positioned on the plug strip (1) with alignment matching the plug receptors and insertion guide holes (12), characterized in that the plug strip (1) is formed as an angle strip with a first strip shoulder (2) and a second strip shoulder (3) perpendicular to the first strip shoulder, and wherein the contact pins (4) are mounted either on the first or on the second strip shoulder (2, 3), whereby engaging hooks (13) are present on each of the two strip shoulders (2, 3) on an inner side of said first strip shoulder and said second strip shoulder (2.1, 3.1) facing the plug part (5) that are mirror images with respect to an angle-bisecting plane of the plug strip (1), and engaging steps (14) are provided in the vicinity of the two longitudinal sides (9, 10) of the socket housing (8) on the plug part (5) that are configured to be engaged by the engaging hook (13) of the plug strip and whose separation from the adjacent edges between the pertinent longitudinal side (9, 10) and the face side (11) of the socket housing (8) or a theoretical edge line corresponding to the mirror-image positioning of the engaging hooks (13) is the same.

2. The plug connector as in claim 1, wherein the engaging hooks (13) on each tree end or end area of the strip shoulders (2, 3) of the plug strip (1) and the engaging hooks (14) are located on two cross side walls (15) of the socket housing (8) on the plug part (5).

3. The plug connector as in claim 2, further including a side wall (16) with a defined height in the area of the engaging hooks (13) on one side of the plug strip (1) on the pertinent strip shoulder (3), and only the cross side wall (15) on the socket housing (8) of the plug part (5) that is to be positioned facing toward this projecting side wall (16) across from each longitudinal side (10) or from the face side (11) of the socket housing (8) on the plug part (5) includes a recoil (17) with corresponding depth.

4. The plug connector as in claim 1 wherein on at least one longitudinal side (9, 10) of the socket housing (8) on the plug part (5) along its longitudinal direction in a row one after the other, additional insertion guide holes (18) run parallel to one another and perpendicular to this longitudinal side (9, 10) for the contact pins (4) on one of the strip shoulders (2, 3) of the plug strip (1), and additional insertion holes (19) are positioned on the face side (11) on the socket housing (8) which from the edge or from the theoretical edge line in the transition area between the front face (11) of the socket housing (8) and its longitudinal side (9) with the additional insertion guide holes (18) has the same separation as do the engaging steps (14) along this longitudinal side (9) of the socket housing (8).

5. The plug connector as in claim 4, wherein the additional insertion holes (19) are formed on the cross walls (15) of the socket housing (8).

6. The plug connector as in claim 4, wherein the additional insertion holes (18) along the pertinent longitudinal side (9) of the socket housing (8) are surrounded by collars (20) that project along the longitudinal side (9) and surround the insertion holes (18) along their side facing away from face side (11) of the socket housing (8), between which gusset spaces (21) are formed, and that coding angles (22) are provided that are configured to engage between the additional insertion holes (18) to the socket housing (8), and that possess a thickened head (23) that is shaped on the end of the flank that fits into the above mentioned gusset spaces (21) for whose engagement an engaging projection (25) is mounted on the opposing side of the socket housing (8).

7. The plug connector as in claim 1, further including coding ribs (26) that are configured to be broken off are provided located between the contact pins (4) that project along the inner sides (2.1, 3.1) of the pertinent strip shoulders (2, 3) of the plug strip (1) on which the contact pins (4) are mounted, and that these coding ribs (26) blend into the those areas of the socket housing (8) on the plug part (5) that are at least partially covered by coding angles that are configured to be mounted so that contact by the plug part (5) with the plug strip (1) is prevented.

* * * * *